US009657689B2

(12) United States Patent
Baasch et al.

(10) Patent No.: US 9,657,689 B2
(45) Date of Patent: May 23, 2017

(54) MODULATING BYPASS VALVE

(75) Inventors: Oswald Baasch, Bowling Green, KY (US); Jon A. Bigley, Bowling Green, KY (US)

(73) Assignee: International Engine Intellectual Property Comapny, LLC., Lisle, IL (US)

( * ) Notice: Subject to any disclaimer, the term of this patent is extended or adjusted under 35 U.S.C. 154(b) by 284 days.

(21) Appl. No.: 14/400,310

(22) PCT Filed: May 10, 2012

(86) PCT No.: PCT/US2012/037213

§ 371 (c)(1),
(2), (4) Date: Nov. 10, 2014

(87) PCT Pub. No.: WO2013/169253

PCT Pub. Date: Nov. 14, 2013

(65) Prior Publication Data

US 2015/0176538 A1 Jun. 25, 2015

(51) Int. Cl.

| | |
|---|---|
| ***F02M 26/26*** | (2016.01) |
| ***F02M 25/07*** | (2006.01) |
| ***F02M 26/38*** | (2016.01) |
| ***F02M 26/56*** | (2016.01) |
| ***F02M 26/61*** | (2016.01) |
| ***F02M 26/54*** | (2016.01) |
| ***F02M 26/70*** | (2016.01) |
| *F02M 26/00* | (2016.01) |
| *F02M 26/71* | (2016.01) |
| *F02M 26/51* | (2016.01) |

(52) U.S. Cl.
CPC ..... *F02M 25/0793* (2013.01); *F02M 26/26* (2016.02); *F02M 26/38* (2016.02); *F02M 26/54* (2016.02); *F02M 26/56* (2016.02); *F02M 26/615* (2016.02); *F02M 26/70* (2016.02); *F02M 26/51* (2016.02); *F02M 26/71* (2016.02); *F02M 2026/0025* (2016.02)

(58) Field of Classification Search
CPC ..... F02M 26/25; F02M 26/26; F02M 26/38; F02M 26/56; F02M 26/615; F02M 2026/0025
USPC ..... 123/336, 337, 568.12, 568.2
See application file for complete search history.

(56) References Cited

U.S. PATENT DOCUMENTS 4,020,809 A * 5/1977 Kern ..... F02D 9/04 123/568.24
4,365,608 A * 12/1982 Bradshaw ..... F02M 26/56 123/568.29
4,409,945 A * 10/1983 Rachedi ..... F02M 26/48 123/568.29

(Continued)

*Primary Examiner* — Erick Solis
(74) *Attorney, Agent, or Firm* — Jack D. Nimz; Jeffrey P. Calfa

(57) ABSTRACT

A modulating bypass valve includes a valve housing defining a modulating fluid passageway and a bypassing fluid passageway through the valve housing. The valve also includes a throttle plate assembly that is inserted through the valve housing and has a rotating shaft on an axis that is generally perpendicular to the modulating fluid passageway and the bypassing fluid passageway. A modulating throttle plate is attached to the shaft and located within the modulating fluid passageway. A bypassing throttle plate is attached to the shaft and located within the bypassing fluid passageway. An actuator rotates the shaft.

13 Claims, 5 Drawing Sheets

(56) References Cited

U.S. PATENT DOCUMENTS

| | | | | | |
|---|---|---|---|---|---|
| 4,428,353 | A * | 1/1984 | Stahly | F02M 26/56 | 123/568.3 |
| 5,035,213 | A * | 7/1991 | Pfalzgraf | F02D 11/10 | 123/336 |
| 5,419,293 | A * | 5/1995 | Nagai | B60K 28/16 | 123/336 |
| 7,814,748 | B2 * | 10/2010 | Nydam | F02D 9/1095 | 137/595 |
| 7,845,338 | B2 * | 12/2010 | Smith | F28D 7/1669 | 123/568.12 |
| 2007/0028901 | A1 * | 2/2007 | Watakabe | F02M 26/38 | 123/568.12 |
| 2008/0257316 | A1 * | 10/2008 | Modien | F02M 26/25 | 123/568.2 |
| 2010/0108041 | A1 * | 5/2010 | Gruner | F02M 26/73 | 123/568.12 |

* cited by examiner

FIG. 3
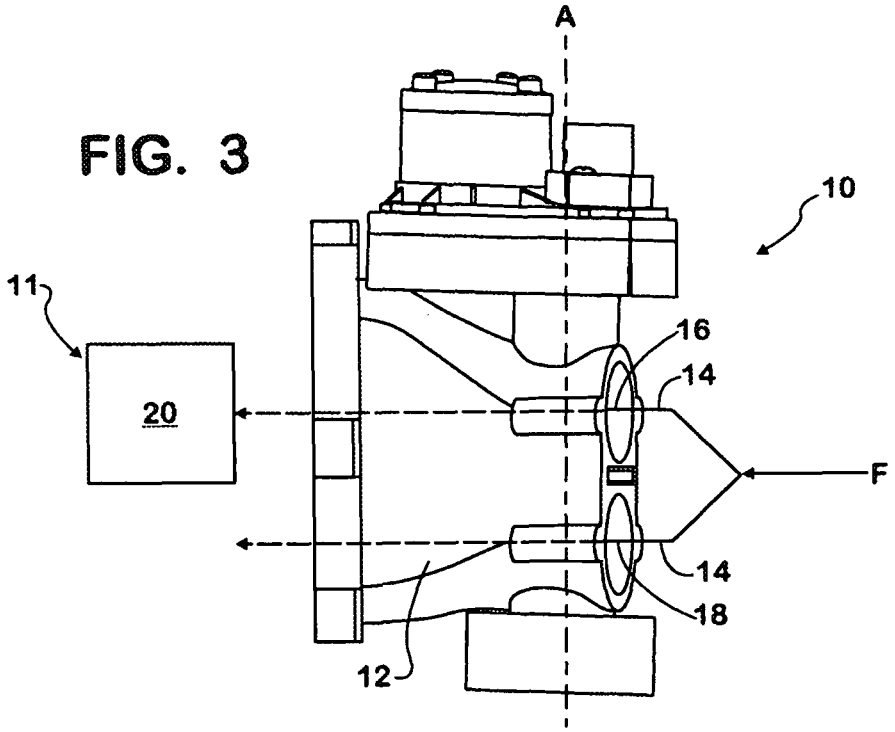
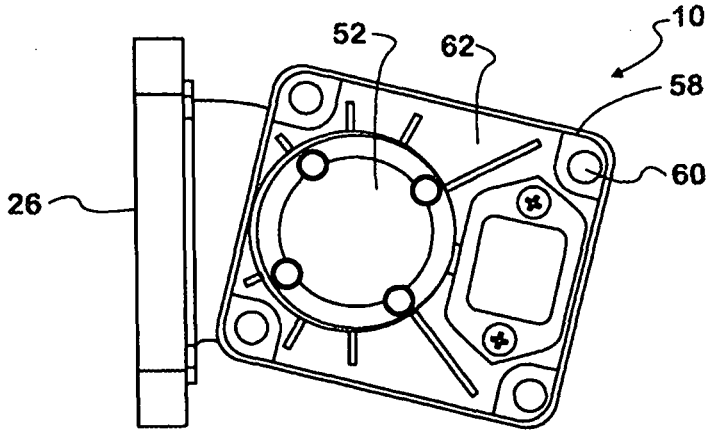
FIG. 4

MODULATING BYPASS VALVE

BACKGROUND

Embodiments described herein relate generally to valves that control a flow of fluid, and more particularly, to valves for controlling the flow of fluid in engine exhaust gas recirculation (EGR) systems.

Engine exhaust gas recirculation is a known technique for reducing oxides of nitrogen in products of combustion that are exhausted from an internal combustion engine to the atmosphere. A typical EGR system comprises an EGR valve that is controlled in accordance with engine operating conditions to regulate the amount of engine exhaust gas that is recirculated to the intake flow entering the engine, so as to limit the combustion temperature, and further, to reduce the formation of oxides of nitrogen during combustion. To the extent that exhaust gas is introduced into the flow entering the engine, the exhaust gas displaces air that would otherwise enter the engine.

The EGR valve is the main emissions control component in the EGR system. The EGR valve is typically located at an intake manifold and is connected between an EGR conduit and the engine. Typically, the EGR valve has a housing that is inserted into an intake manifold pocket, and the EGR valve opens a small exhaust gas recirculation passageway between the EGR conduit and the intake manifold to allow a metered amount of exhaust fluid flow to the engine.

Different amounts of EGR fluid are provided at different engine operating conditions. At cruising, high-speed or mid-range acceleration, when combustion temperatures are very high, high EGR fluid flow is provided. At low speed and light load conditions, low EGR fluid flow is provided. At engine warm-up, transient, idle, or wide open throttle conditions, no EGR fluid flow is provided.

Typically, the flow of EGR fluid is controlled not only by the EGR control valve, but also by a separate modulator assembly. The modulator assembly typically uses the exhaust backpressure (which is proportional to engine load) to send a vacuum signal to control the EGR flow rate through the EGR valve to be generally proportional to the amount of load applied to the engine. A bypass valve can be used to divert excess EGR fluid flow around the EGR cooler during engine conditions where EGR fluid flow is low or not provided.

SUMMARY

A modulating bypass valve includes a valve housing defining a modulating fluid passageway and a bypassing fluid passageway through the valve housing. The valve also includes a throttle plate assembly that is inserted through the valve housing and has a rotating shaft on an axis that is generally perpendicular to the modulating fluid passageway and the bypassing fluid passageway. A modulating throttle plate is attached to the shaft and located within the modulating fluid passageway. A bypassing throttle plate is attached to the shaft and located within the bypassing fluid passageway. An actuator rotates the shaft.

Another modulating bypass valve includes a valve housing defining a modulating fluid passageway and a bypassing fluid passageway through the valve housing. A throttle plate assembly is inserted through the valve housing and has a modulator shaft on an axis that is generally perpendicular to the modulating fluid passageway, and a bypassing shaft on an axis that is generally perpendicular to the bypassing fluid passageway. A modulating throttle plate is attached to the modulator shaft and located within the modulating fluid passageway. A first actuator rotates the modulator shaft and the modulating throttle plate within the modulating fluid passageway. A bypassing throttle plate is attached to the bypassing shaft and is located within the bypassing fluid passageway, and a second actuator rotates the bypassing shaft and the bypassing throttle plate within the bypassing fluid passageway.

A method of modulating and bypassing EGR fluid flow in a valve of an EGR system includes providing a valve housing defining a modulating fluid passageway and a bypassing fluid passageway through the valve housing, rotating a modulating throttle plate within the modulating fluid passageway to selectively open and close the modulating fluid passageway, and rotating a bypassing throttle plate within the bypassing fluid passageway to selectively open and close the bypassing fluid passageway. The method further includes fluidly communicating the EGR fluid flow through at least one of the modulating fluid passageway and the bypassing fluid passageway.

BRIEF DESCRIPTION OF THE DRAWINGS

FIG. 3 is a side view of the modulating bypass valve.

FIG. 4 is a top view of the modulating bypass valve.

DETAILED DESCRIPTION

Figure 1:
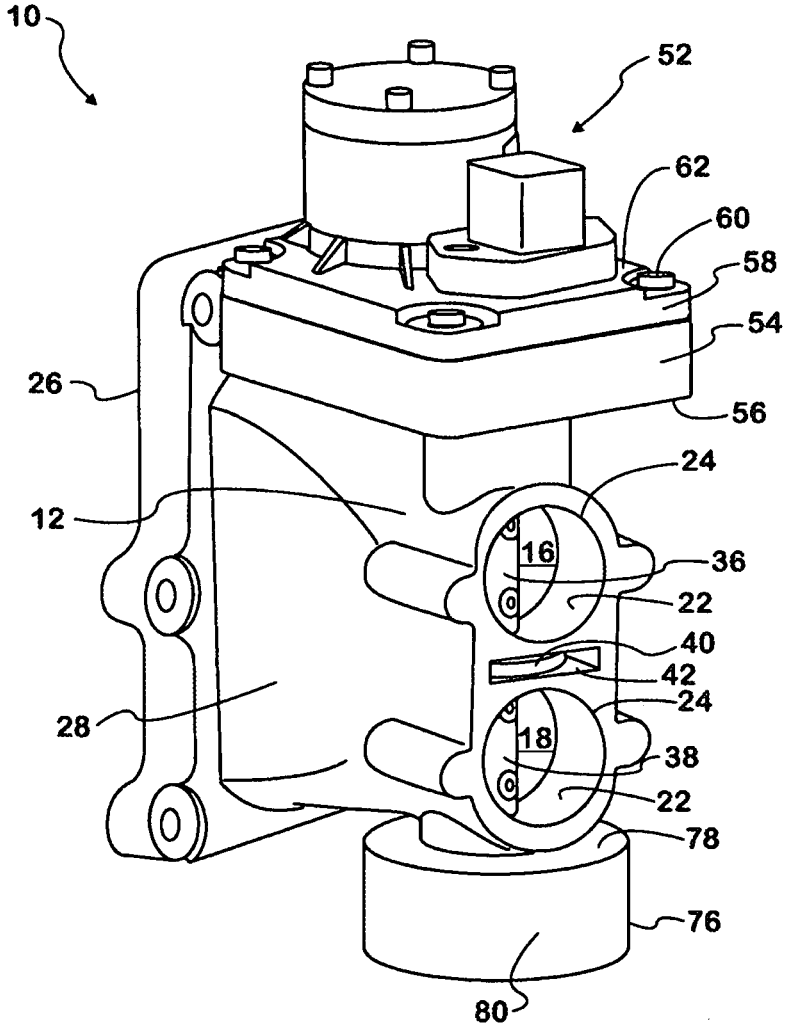
FIG. 1 is a side perspective view of a modulating bypass valve for controlling EGR fluid flow, with throttle plates removed for clarity.
Figure 2:
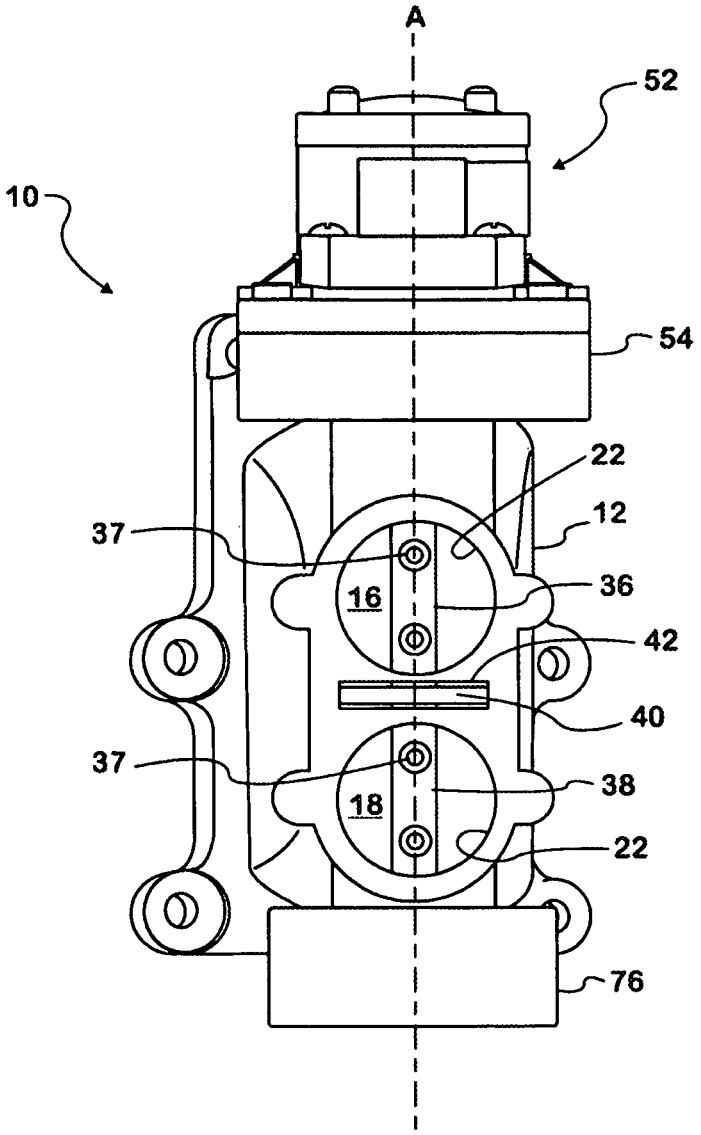
FIG. 2 is a front view of the modulating bypass valve with throttle plates removed for clarity.

Referring to FIGS. 1-5, a modulating bypass valve is indicated generally at 10 and includes a valve housing 12 having two or more fluid passageways 14 (see FIG. 3) that include a modulating fluid passageway 16 and a bypassing fluid passageway 18. While the modulating bypass valve 10 will be explained with reference to use in a vehicle EGR system 11, it should be appreciated that the modulating bypass valve can be used in any application for modulation of fluid and bypassing fluid in a single valve housing 12. In the modulating bypass valve 10, the single valve housing 12 can be used in an EGR system 11 to modulate the EGR fluid flow F through the EGR cooler 20 via modulating fluid passageway 16, and to bypass excess EGR fluid flow around the EGR cooler via bypassing fluid passageway 18. The valve housing 12 may be unitarily formed or formed in multiple parts. It should also be understood that the fluids running through the modulating bypass valve 10 may be of different types, for example the modulating fluid passageway 16 may have EGR fluid flow, while the bypassing fluid passageway 18 may have air, among other fluids. In the modulating bypass valve 10 of FIG. 3, the fluid passageways 14 are parallel to each other but they can be orthogonal to each other, or have any configuration to fit an engine or other application.

The modulating fluid passageway 16 and the bypassing fluid passageway 18 may be defined by through-bores 22 in the valve housing 12. These through-bores 22 can be of any size, but may range between 30 to 50 mm. The size of the through-bores 22 may be the same or may be different. One application might require a large through-bore 22 for the modulating fluid passageway 16 and a small through-bore for the bypassing fluid passageway 18 (flow restricting the bypass flow at high flow conditions) or vice versa (flow restricting the modulating flow at high flow conditions). EGR fluid flow F, which for purposes of the modulating bypass valve 10 include gas, liquid and solid (pellets, powder), may flow in the direction indicated at FIG. 3 to enter an inlet 24 at the through-bores 22 and exit at an outlet 26 at a diffuser 28. Alternately, it is possible that the EGR fluid F may flow in the opposition direction as indicated in FIG. 3, flowing into the outlet 26 at the diffuser 28 and out the inlet 24 at the through-bores 22. If the flow is reversed from the direction shown in FIG. 3, the valve 10 can become a mixing valve. The modulating fluid passageway 16 and the bypassing fluid passageway 18 provide fluid communication between the inlet 24 and the outlet 26.

Modulation of the EGR fluid F and bypassing of the EGR fluid F is effected by a throttle plate assembly. 30 inserted in the valve housing 12, including a modulating throttle plate 32 and a bypassing throttle plate 34 which are positioned within the modulating fluid passageway 16 and the bypassing fluid passageway 18, respectively, on a modulator shaft 36 and a bypassing shaft 38, respectively. The modulating throttle plate 32 is fixed to and rotational on the modulator shaft 36, and the bypassing throttle plate 34 is fixed to and rotational on the bypassing shaft 38. Both the modulator shaft 36 and the bypassing shaft 38 define a shaft axis A, which is generally perpendicular to the through-bores 22 defining the modulating fluid passageway 16 and the bypassing fluid passageway 18. The modulator shaft 36 and the bypassing shaft 38 may be the same shaft.

Generally circular or disk-shaped, the throttle plates 32, 34 may be attached to the modulator shaft 36 and the bypassing shaft 38 with fasteners 39 such as screws into receiving holes 37 on the shafts 36, 38. The throttle plates 32, 34 are sized and shaped to be rotational within the fluid passageways 16, 18, and to be generally the same size or slightly smaller than the x-sectional area of the passageways 16, 18, however it is possible that the throttle plates 32, 34 may have other shapes and sizes. The throttle plates 32, 34 are rotational on shafts 36, 38 about shaft axis A to selectively impede or allow the flow of EGR fluid F through the modulating fluid passageway 16 and the bypassing fluid passageway 18, respectively.

The throttle plate assembly 30 may have a clutch driver 40 that couples the modulator shaft 36 to the bypassing shaft 38. The clutch driver 40 may be received in a housing pocket 42, which is an opening defined by the valve housing 12 that is parallel with the modulating fluid passageway 16. The clutch driver 40 may be a generally round disk 44 with a through-bore 46 for receiving a second end 48 of the modulator shaft 36 and a first end 50 of the bypassing shaft 38. The clutch driver 40 is parallel to the axis defined by the fluid passageways 14, and located between the modulating fluid passageway 16 and the bypassing fluid passageway 18. When coupled with the clutch driver 40, both the modulator shaft 36 and the bypassing shaft 38 are actuated by an actuator 52.

The clutch driver 40 may have several configurations. The clutch driver 40 may be mechanical, for example a ratchet-type. The clutch driver 40 may also be electric, for example an electric-magnetic coupling. Further, the clutch driver 40 may be hydraulic, for example a hydraulic coupling or a hydraulic-mechanical coupling. Further still, the clutch driver 40 may be a magnetic coupling, a pneumatic coupling, or a pneumatic-mechanical coupling. The clutch driver 40 may also be a damper, for example a pneumatic or hydraulic damper which can close off EGR fluid flow F during engine transient conditions. The clutch driver 40 might also contain a magnetic or electric rheological fluid that changes it viscous characteristics via magnetic or electric input. In high loading conditions or at a preset time constant, the damper can open and revert to a default rotation of both throttle plates 32, 34 under spring force.

Figure 5:
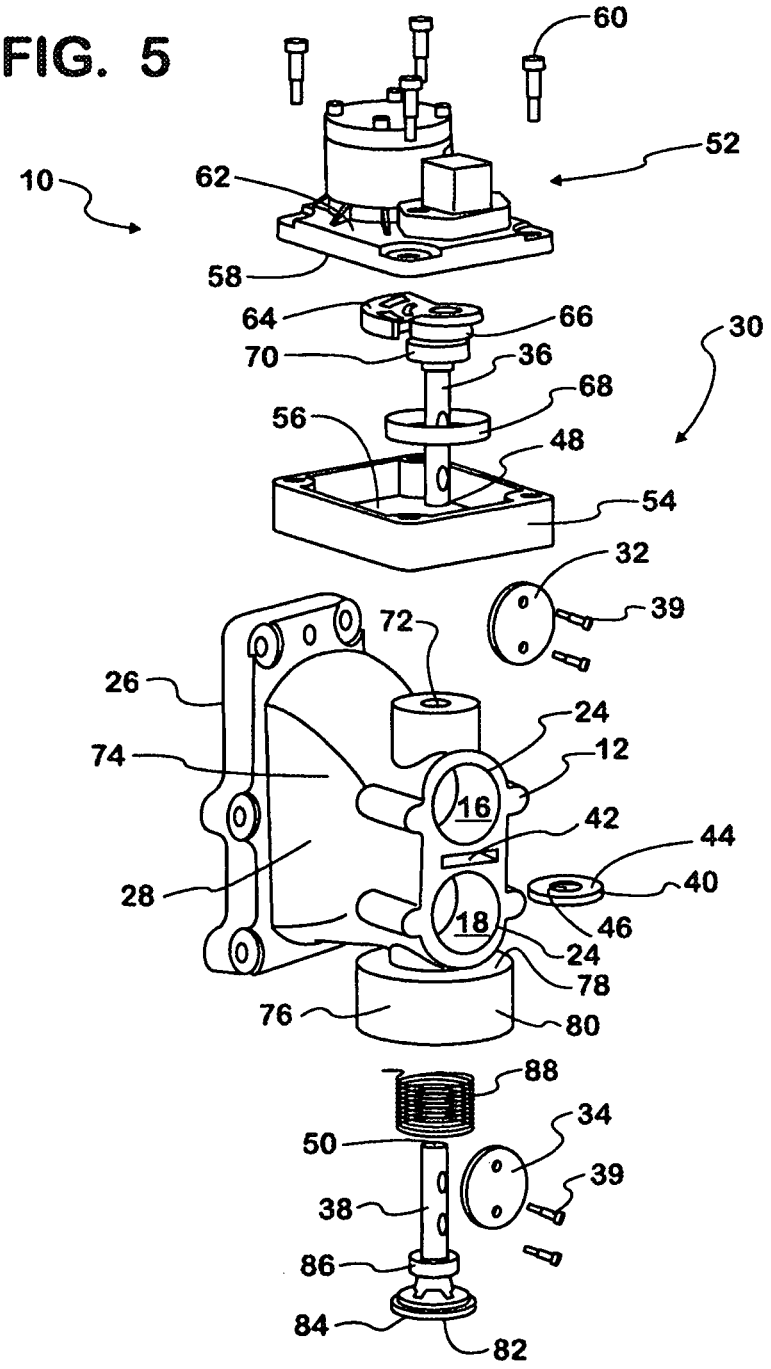
FIG. 5 is an exploded view of the modulating bypass valve.

Referring to FIG. 5, the valve housing 12 may include a header portion 54 having a lower tray 56 and a cover 58 that are configured to be fastened together, such as with bolts 60. Bolts 60 assemble the actuator 52 to the valve flange of header portion 54. The header portion 54 can be casted to a main valve body 74 but can also be held together via bolts similar to the bolts 60 but in a offset configuration external or internal to the bolt 60 pattern. The lower tray 56 receives the modulator shaft 36 through a receiving hole (not shown) that is generally aligned with shaft axis A. The actuator 52 may be disposed on a distal side 62 of the cover 58 and be coupled to a gear 64 located on a first end 66 of the modulator shaft 36. The gear 64 at the first end 66 of the modulator shaft 36 may be a single stage gear or a multi-stage gear for translating the speed of the actuator 52 to torquing of the modulator shaft, and through the clutch driver 40, to torquing of the bypassing shaft 38. Alternatively, it is possible that the actuator 52 rotates the bypassing shaft 38, and through the clutch driver 40, rotates the modulator shaft 36.

A return spring 68 is disposed around the modulator shaft 36 between the lower tray 56 and the gear 64. The return spring 68 is configured to rotate the modulator shaft 36 to a default position when the actuator 52 is not actuated. In a default position of the modulator shaft 36, the modulating throttle plate 32 may be generally parallel with the modulating fluid passageway 16, may be generally perpendicular to the modulating fluid passageway, or may be at any location therebetween. The default position may have the modulating throttle plate 32 in a closed condition. However, depending on the EGR strategy, the default position may have the modulating throttle plate 32 in a slightly opened condition using the balancing spring assembly 68, or may have the modulating throttle plate in a opened position.

When the cover 58 is attached to the lower tray 56, the gear 64, a bearing 70 and the spring 68 may be contained within the header portion 54. The receiving hole (not shown) of the header portion 54 is aligned with a receiving channel 72 in a main valve body 74. The receiving channel 72 is generally coaxial with the shaft axis A and is generally perpendicular to the modulating fluid passageway 16 and to the bypassing fluid passageway 18.

The first end 50 of the bypassing shaft 38 is attached to the clutch driver 40. The bypassing shaft 38 extends from the clutch driver 40 along shaft axis A generally perpendicularly through the bypassing fluid passageway 18 to a retaining portion 76 of the valve housing 12. The retaining portion 76 has a surface 78 that is generally perpendicular to the shaft axis A, and may include a lip or walls 80 extending from the surface that are generally parallel to shaft axis A. The bypassing shaft 38 may extend through the surface 78 and have a second end 82 with an enlarged head 84. The bypassing shaft 38 may also include a bearing 86 for allowing the relative rotation of the bypassing shaft with respect to the retaining portion 76. Disposed around the bypassing shaft 38 and between the surface 78 and the enlarged head 84 is a return spring 88 which returns the bypassing shaft 88 to a default position when the actuator 52 is not actuated. As with the modulator throttle plate 32, the bypassing throttle plate 34 may have any default position.

For example, for a cold start-up of the engine, the bypassing throttle plate 34 may be generally parallel to the bypassing fluid passageway 18 in a fully open position to aid the warm-up phase of the engine.

Using exhaust backpressure, which is typically proportional to engine load, the actuator 52 actuates the rotation of the modulator shaft 36 and the bypassing shaft 38 to control the EGR fluid flow F through the modulating fluid passageway 16 and the bypassing fluid passageway 18, respectively. It is possible that the actuator 52 may use engine conditions and signals other than, or in addition to, exhaust backpressure to actuate rotation of the modulator shaft 36 and/or bypassing shaft 38.

The actuator 52 may control the rotation of the modulating throttle plate 32 and the bypassing throttle plate 34 in the following way: under transient operating conditions, the actuator 52 may rotate the modulating throttle plate 32 to close-off the modulating fluid passageway 16 (by positioning the modulating throttle plate generally perpendicular to the flow of EGR fluid, i.e. to impede the flow of EGR fluid flow through passageway 16) and by rotating the bypassing throttle plate 34 to open the bypassing fluid passageway 18 (by positioning the bypass throttle plate to be generally parallel to the flow of EGR fluid, i.e. to allow the flow of EGR fluid through the bypass passageway 18). When the bypassing throttle plate 34 is at least partially open (not perpendicular to the direction of EGR fluid flow F), then there will be fluid communication of EGR fluid through the bypassing fluid passageway 18 around the EGR cooler.

Similarly, the actuator 52 may control the rotation of the modulating throttle plate 32 and the bypassing throttle plate 34 in the following way: under high load operating conditions, the actuator 52 may rotate the modulating throttle plate 32 to open the modulating fluid passageway 16 (by positioning the modulating throttle plate generally parallel to the flow of EGR fluid, i.e. to allow the flow of EGR fluid through passageway 16) and by rotating the bypassing throttle plate 34 to close the bypassing fluid passageway 18 (by positioning the bypass throttle plate to be generally perpendicular to the flow of EGR fluid, i.e. to impede the flow of EGR fluid through the bypass passageway 18). When the modulating throttle plate 32 is at least partially open (not perpendicular to the direction of EGR fluid flow F), then there will be fluid communication of EGR fluid through the modulating fluid passageway 16 to the EGR cooler 20.

The actuator 52 may control the rotation of the modulating throttle plate 32 and the bypassing throttle plate 34 in the following way: in low load operating conditions, the actuator 52 may rotate the modulating throttle plate 32 to a position between 0 and 90-degrees to the direction of EGR fluid flow F (by positioning the modulating throttle plate to partially open the modulation fluid passageway 16 to allow a portion of the EGR fluid flow F through the modulating passageway) and to rotate the bypassing throttle plate 34 to a position between 0 and 90-degrees to the direction of EGR fluid flow (by positioning the bypassing throttle plate to partially open the bypassing fluid passageway 18 to allow a portion of the fluid flow through the bypassing passageway).

It should be understood that the throttle plates 32, 34 may be located in the same rotational plane about shaft axis A, or may be rotationally offset from each other about shaft axis A. The throttle plates may be parallel, orthogonal to each other, or at any angle therebetween. The modulating throttle plate 32 may have a default position that is about 45-degrees to the direction of EGR fluid flow F, although other orientations are possible. The bypassing throttle plate 34 may have a default position to be generally perpendicular to the direction of EGR fluid flow F, generally parallel to the direction of EGR fluid flow F, and all other orientations are possible.

With the modulating bypass valve 10, the rotation of the modulating throttle plate 32 and the bypassing throttle plate 34 can be controlled by the actuator 52 by as much as 0.5 degrees rotation about the shaft axis A, although it is possible that greater control may be exhibited by the actuator. It should be appreciated that the actuator 52 can operate the modulating throttle plate 32 and the bypassing throttle plate 34 to various positions according to various engine operating conditions and/or preset time constants. It should also be understood that any default position may be set for the throttle plates 32, 34, with or without springs 68, 88 returning the plates to their default positions when the actuator 52 does not rotate the plates. Further, the rotation of the throttle plates 32, 34 may be preset to achieve fixed EGR fluid flow F.

Figure 6:
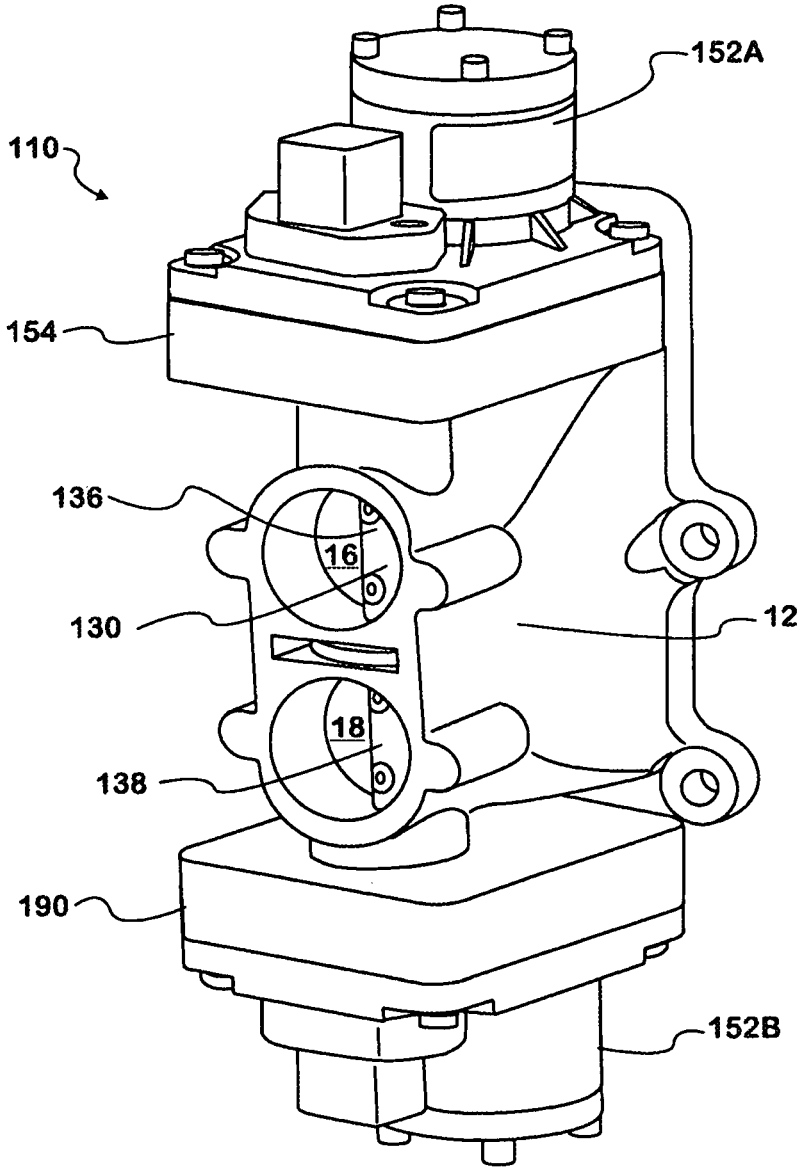
FIG. 6 is an alternate embodiment of a modulating bypass valve with throttle plates removed for clarity.

Referring to FIG. 6, an alternate embodiment of modulating bypass valve is indicated generally at 110 is generally similar to the modulating bypass valve 10 having generally similar components. The modulation bypass valve 110 includes a first actuator 152A in a header portion 154 of the valve housing 12 and a second actuator 152B in a footer portion 190 of the valve housing. The throttle plate assembly 130 of the modulating bypass valve 100 may have the modulator shaft 136 and the bypassing shaft 138 independently actuated with actuators 152A and 152B, respectively. With independently actuated shafts 136, 138, the throttle plates (not shown) fixed to the shafts are independently rotational from one another. The throttle plates may be rotated independently as a function of EGR flow rate and air intake restriction to induce flow.

With respect to the actuator 52 of the modulating bypass valve 10 of FIGS. 1-5, and the first and second actuators 152A, 152B of the modulating bypass valve of FIG. 6, the actuator can be electronic, electro-hydraulic, electro-pneumatic (air only or air over oil), among other types. Further with respect to the modulating bypass valve 10, 110, the following arrangements of actuators 52, 152A, 152B may be implemented: one electronic actuator with clutch driver 40; one electro-hydraulic actuator with clutch driver 40; one electro-pneumatic with clutch driver 40; one mechanical actuator with clutch driver 40; two electronic actuators without a clutch driver 40, two electronic without a clutch driver 40 where one actuator is the master and the other actuator is the slave; one electronic actuator and one electro-hydraulic actuator without a clutch driver 40; one electronic actuator and one electro-pneumatic without a clutch driver 40; one electronic actuator and one diaphragm operated via vacuum or manifold pressure; one electronic actuator with single shaft (shafts 36, 38 combined into one shaft with no clutch driver 40) where the throttle plates are offset a predetermined angle that is a function of EGR flow rate and air intake restriction to induce flow; and one electro-hydraulic and one electro-pneumatic without a clutch driver 40. Other numbers, types and arrangements of actuators 52, 152A, 152B, shafts 36, 38, 136, 138 and plates 32, 34 may be implemented into the modulating bypass valve 10, 110. The shafts 136, 138 may define the same axis A, may be parallel, or may be anti-parallel.

In embodiments of the modulating bypass valve 10, 110, the electric actuator 52, 152A, 152B may be powered by 12, 24, 48 VDC or 110/220/440 VAC single or multiphase power sources. In the modulating bypass valve 10, 110, the hydraulic/pneumatic actuator 52, 152A, 152B may be driven by engine pressurized oil lubricating system, pressurized oil pressure amplification system, the fuel system, and the coolant system, among others.

The modulating bypass valve 10, 110 can operate to both modulate EGR fluid flow F and to bypass EGR fluid flow F, to modulate EGR fluid flow F only, or to bypass EGR fluid flow F only. Additionally, the modulating bypass valve 10 is in a single, relatively compact housing that achieves low pressure losses through the EGR system 11.

What is claimed is:

1. A modulating bypass valve comprising:

a valve housing defining a housing pocket, modulating fluid passageway and a bypassing fluid passageway through the housing;

wherein the housing is an opening in the valve housing that is parallel to the modulating fluid passageway and located between the modulating fluid passageway and the bypassing fluid passageway;

a throttle plate assembly inserted through the valve housing and having a rotating shaft on an axis that is generally perpendicular to the modulating fluid passageway and the bypassing fluid passageway;

wherein the shaft comprises a modulator shaft and a bypassing shaft that are coupled together with a clutch driver;

a modulating throttle plate attached to the modular shaft and located within the modulating fluid passageway;

a bypassing throttle plate attached to the bypassing shaft and located within the bypassing fluid passageway; and an actuator for rotating the shaft.

2. The valve of claim 1 wherein the modulating fluid passageway and the bypassing fluid passageway are generally parallel.

3. The valve of claim 1 wherein the clutch driver is one of mechanical, electric, hydraulic, magnetic, and pneumatic.

4. The valve of claim 1 wherein the modulating throttle plate is a disk that is sized and shaped to be generally the same size and shape as a cross-section of the modulating fluid passageway.

5. The valve of claim 1 further comprising a return spring disposed around the shaft for rotating the shaft to a default position when the actuator is not actuated.

6. The valve of claim 1 wherein the modulating throttle plate and the bypassing throttle plate are rotationally offset from each other on the axis.

7. A modulating bypass valve comprising:

a valve housing defining a housing pocket, a modulating fluid passageway and a bypassing fluid passageway through the valve housing; wherein the housing pocket is an opening in the valve housing that is parallel to the modulating fluid passageway and located between the modulating fluid passageway and the bypassing fluid passageway;

a throttle plate assembly inserted through the valve housing and having a modulator shaft on an axis that is generally perpendicular to the modulating fluid passageway, and a bypassing shaft on an axis that is generally perpendicular to the bypassing fluid passageway;

wherein the modulator shaft and the bypassing shaft are coupled together with a clutch driver;

a modulating throttle plate attached to the modulator shaft and located within the modulating fluid passageway;

a first actuator for rotating the modulator shaft and the modulating throttle plate within the modulating fluid passageway;

a bypassing throttle plate attached to the bypassing shaft and located within the bypassing fluid passageway; and a second actuator for rotating the bypassing shaft and the bypassing throttle plate within the bypassing fluid passageway.

8. The valve of claim 7 wherein the modulator shaft and the bypassing shaft define the same axis.

9. The valve of claim 7 further comprising a return spring disposed around the modulator shaft for rotating the modulator shaft to a default position when the first actuator is not actuated, and a second return spring disposed around the bypassing shaft for rotating the bypassing shaft to a default position when the second actuator is not actuated.

10. A method of modulating and bypassing EGR fluid flow in a valve of an EGR system, the method comprising the steps of:

providing a valve housing defining a housing pocket, modulating fluid passageway and a bypassing fluid passageway through the valve housing; wherein the housing pocket is an opening in the valve housing that is parallel to the modulating fluid passageway and located between the modulating fluid passageway and the bypassing fluid passageway;

rotating a modulating throttle plate attached to a modulator shaft within the modulating fluid passageway to selectively open and close the modulating fluid passageway;

rotating a bypassing throttle plate attached to a bypassing shaft within the bypassing fluid passageway to selectively open and close the bypassing fluid passageway; wherein the modulator shaft and the bypassing shaft are coupled together with a clutch driver; and fluidly communicating EGR fluid flow through at least one of the modulating fluid passageway and the bypassing fluid passageway.

11. The method of claim 10 further comprising actuating the rotation of the modulating throttle plate and the bypassing throttle plate with at least one actuator.

12. The method of claim 10 further comprising fluidly communicating EGR fluid through the modulating fluid passageway to an EGR cooler when the modulating throttle plate is at least partially open.

13. The method of claim 10 further comprising fluidly communicating EGR fluid through the bypassing fluid passageway to bypass an EGR cooler when the bypassing throttle plate is at least partially open.

* * * * *